US005207036A

United States Patent [19]

Sampson et al.

[11] Patent Number: 5,207,036

[45] Date of Patent: May 4, 1993

[54] SKYLIGHT CONSTRUCTION

[75] Inventors: Robert Sampson, Sanford; Sean Flanigan, Wells, both of Me.

[73] Assignee: Wasco Products, Inc., Sanford, Me.

[21] Appl. No.: 839,743

[22] Filed: Feb. 19, 1992

Related U.S. Application Data

[63] Continuation of Ser. No. 545,364, Jun. 28, 1990, abandoned.

[51] Int. Cl.[5] ..... E04B 7/18

[52] U.S. Cl. ..... 52/72; 52/200; 49/402; 49/484.1

[58] Field of Search ..... 52/72, 200, 397, 398, 52/403; 49/325, 402, 485, 504

[56] References Cited

U.S. PATENT DOCUMENTS

| | | | |
|---|---|---|---|
| 4,237,665 | 12/1980 | Molyneux | 49/485 |
| 4,439,962 | 4/1984 | Jentoft et al. | 52/200 |
| 4,449,340 | 5/1984 | Jentoft et al. | 52/200 |
| 4,455,799 | 6/1984 | Jentoft et al. | 52/200 |
| 4,466,221 | 8/1984 | Couture | 52/200 |
| 4,570,393 | 2/1986 | Minter . | |
| 4,570,394 | 2/1986 | Jentoft et al. | 52/200 |
| 4,757,655 | 7/1988 | Jentoft et al. | 52/200 |
| 4,831,780 | 5/1989 | Bockwinkel | 49/504 |
| 4,862,657 | 9/1989 | Jentoft et al. | 52/200 |
| 4,928,445 | 5/1990 | Sampson et al. . | |
| 4,930,275 | 6/1990 | Verby et al. . | |

*Primary Examiner*—Michael Safavi
*Attorney, Agent, or Firm*—Wolf, Greenfield & Sacks

[57] ABSTRACT

A skylight construction having a wooden base frame extending about a roof opening and secured thereto. The skylight construction is illustrated as a step flash skylight including a rigid plastic curb frame having a base frame and overlying sash frame. A retainer is provided for supporting glazing plates over the sash frame. The PVC base frame is firmly secured to the wooden base frame by interlocking therewith. The PVC base frame has a peripherally disposed counterflashing piece extending downwardly therefrom and having flashing seal means disposed intermediate the counterflashing piece and the wooden base frame.

18 Claims, 7 Drawing Sheets

SKYLIGHT CONSTRUCTION

This application is a continuation of application Ser. No. 545,364, filed Jun. 28, 1990 now abandoned.

BACKGROUND OF THE INVENTION

1. Field of the Invention

The present invention relates in general to an improved skylight construction and is concerned, more particularly, with an improved skylight construction employing a rigid plastic curb frame providing simplified manufacture and improved temperature resistant and weathering properties. Even more particularly, the present invention relates to improvements in skylight features in particular applicable to step flash skylights.

2. Objects of the Invention

It is a general object of the present invention to provide improvements to skylights and, in particular, skylights employing a rigid plastic curb frame.

Another object of the present invention is to provide an improved skylight construction which is in particular applicable to a step flash skylight.

A further object of the present invention is to provide an improved skylight construction used with a wood base frame, providing an improved interlocking arrangement for engagement between the rigid plastic curb frame and the wooden base frame so as to facilitate convenient assembly of the curb frame to the wood base frame.

Another object of the present invention is to provide an improved step flash skylight construction that is of simplified construction, can be manufactured relatively easily and at a relatively low cost and that is simple to install.

Still another object of the present invention is to provide an improved skylight construction that preferably employs a PVC curb frame constructed from an extrusion employing high performance co extruded weather stripping, moisture and condensation protection and control, and integral counterflashing.

Another object of the present invention is to provide an improved skylight construction having improved gasketing and flashing features.

SUMMARY OF THE INVENTION

To accomplish the foregoing and other objects, features and advantages of the invention, there is provided a skylight construction adapted to be fitted into an opening in a building such as either a commercial building or a residential building. The skylight construction comprises a base frame extending about the opening and having means for securing of the base frame about the opening. A rigid plastic curb frame means is provided and is firmly secured to the top of the base frame Transparent or translucent covering means are provided and retained on the rigid plastic curb frame means. In accordance with a preferred embodiment of the present invention, the skylight construction is of step flash skylight type and the base frame is preferably a stepped wooden base frame upon which the rigid plastic curb frame means is secured. The means for firmly securing the rigid plastic curb frame includes means for positively interlocking the rigid plastic curb frame means with the base frame. In an embodiment disclosed herein, this positive interlocking is carried out by means of a slot formed in the base frame interlocking in combination with an interlocking flange of the rigid plastic curb frame means. A securing screw, bolt or the like passing through the base frame positively interlocks and secures the overlying rigid curb frame means with the base frame.

In accordance with another feature of the present invention, there is provided an improved flashing construction. In accordance with this feature, the rigid plastic curb frame means has a peripherally disposed counterflashing piece extending downwardly from the frame means and disposed outwardly of the base frame. The counterflashing piece has flashing seal means disposed intermediate the counterflashing piece and the base frame.

In accordance with another feature of the present invention, there is an improved gasket construction, particularly for a gasket used with a hinged skylight. The gasket construction provides four-point gasketing for locking out air and moisture and provides superior energy efficiency and weather tightness. The gasket is in the form of a co-extruded gasket with two point engagement with the rigid curb frame means.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 5:
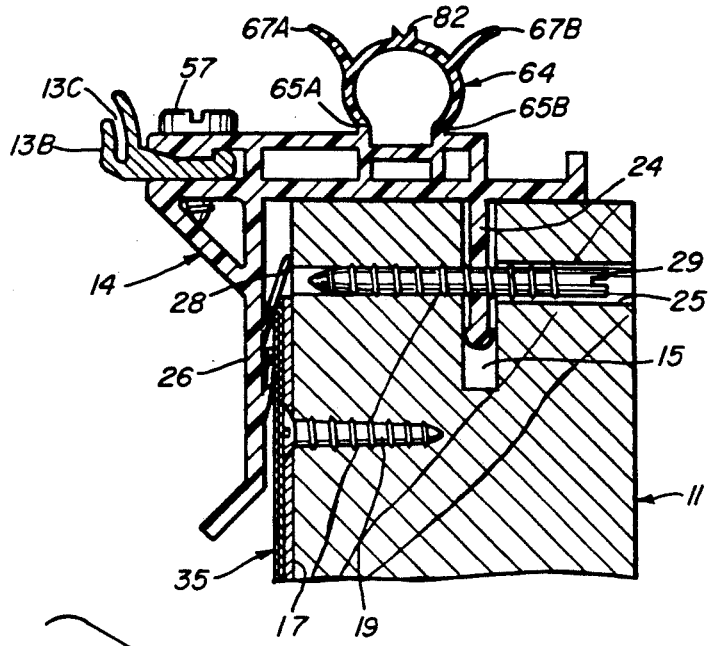
FIG. 5 is a cross sectional view through a segment of the skylight construction showing the manner in which the curb frame is attached to the wooden base frame.
Figure 6:
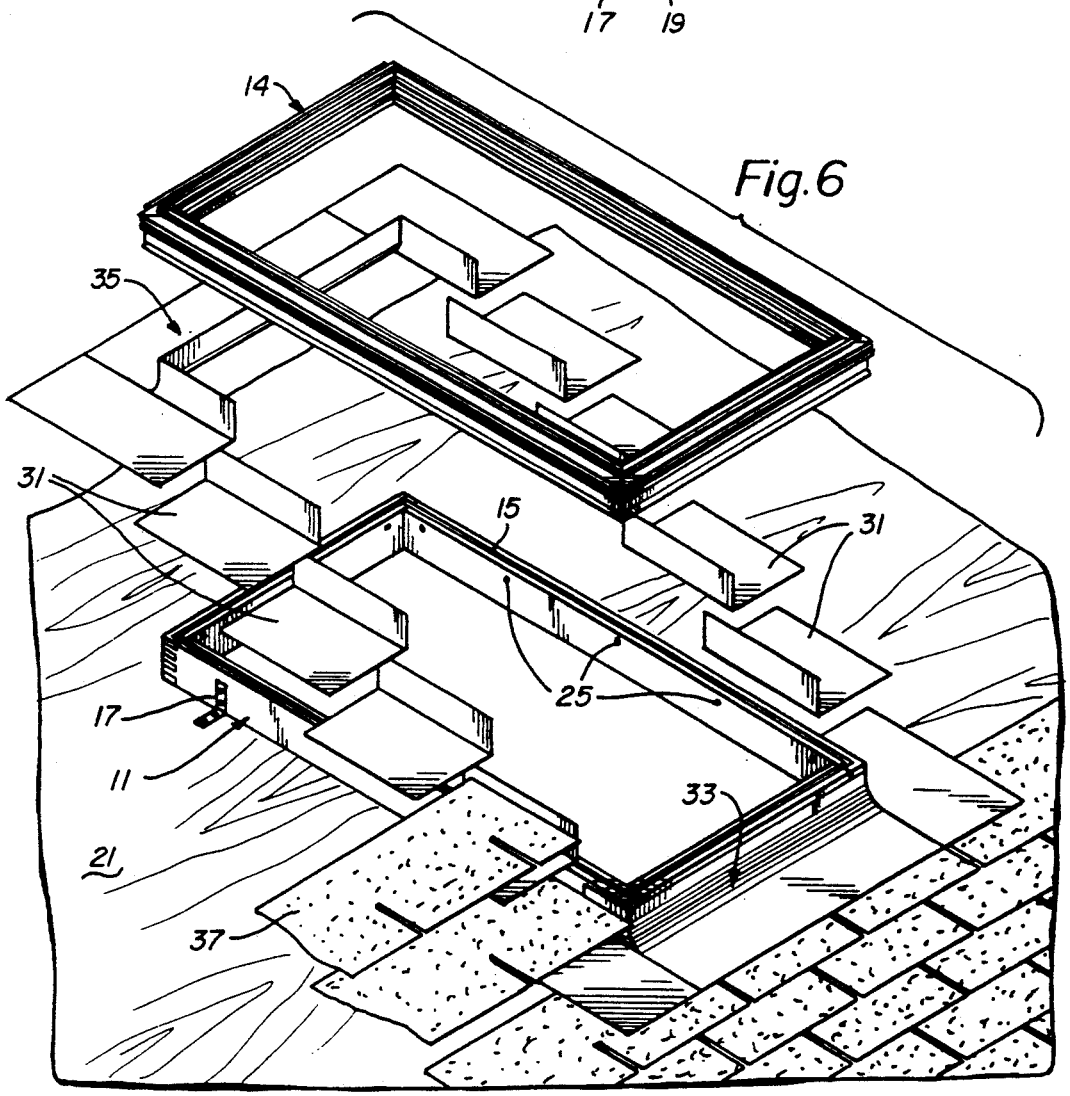
FIG. 6 is an exploded perspective view illustrating the components of the skylight construction of the present invention and the manner in which the components are assembled including flashing members and the curb frame.
Figure 7:
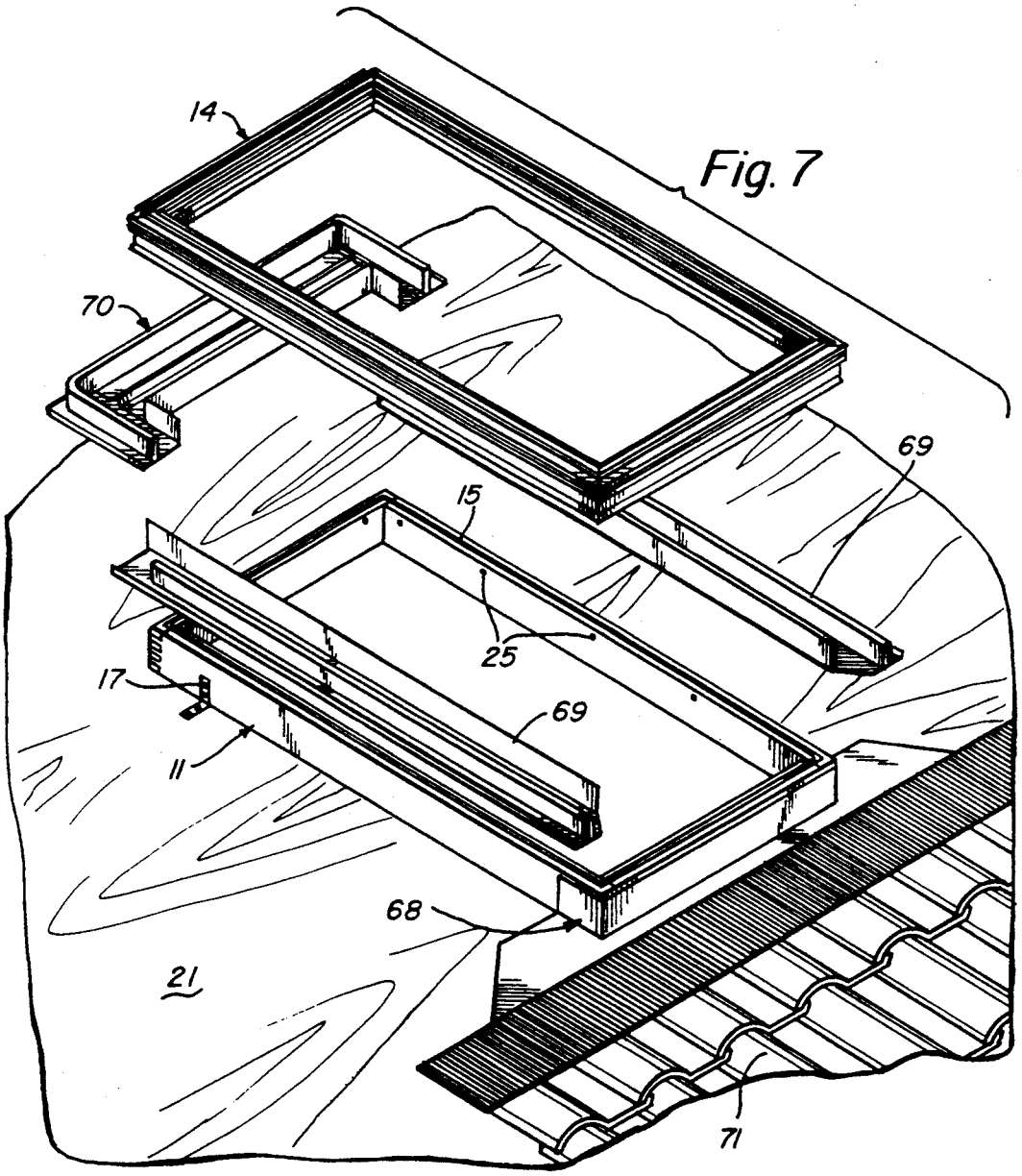
FIG. 7 is a further exploded perspective view showing a different embodiment of skylight components employed in particular in connection with a roof construction employing roofing tiles.

Reference is now made to the drawings for an illustration of constructions of the present invention. FIGS. 1–6 illustrate a preferred construction for the skylight. FIG. 7 illustrates an alternate embodiment for use with tile roofs. FIGS. 8–11 illustrate a preferred hinge construction.

Figure 1:
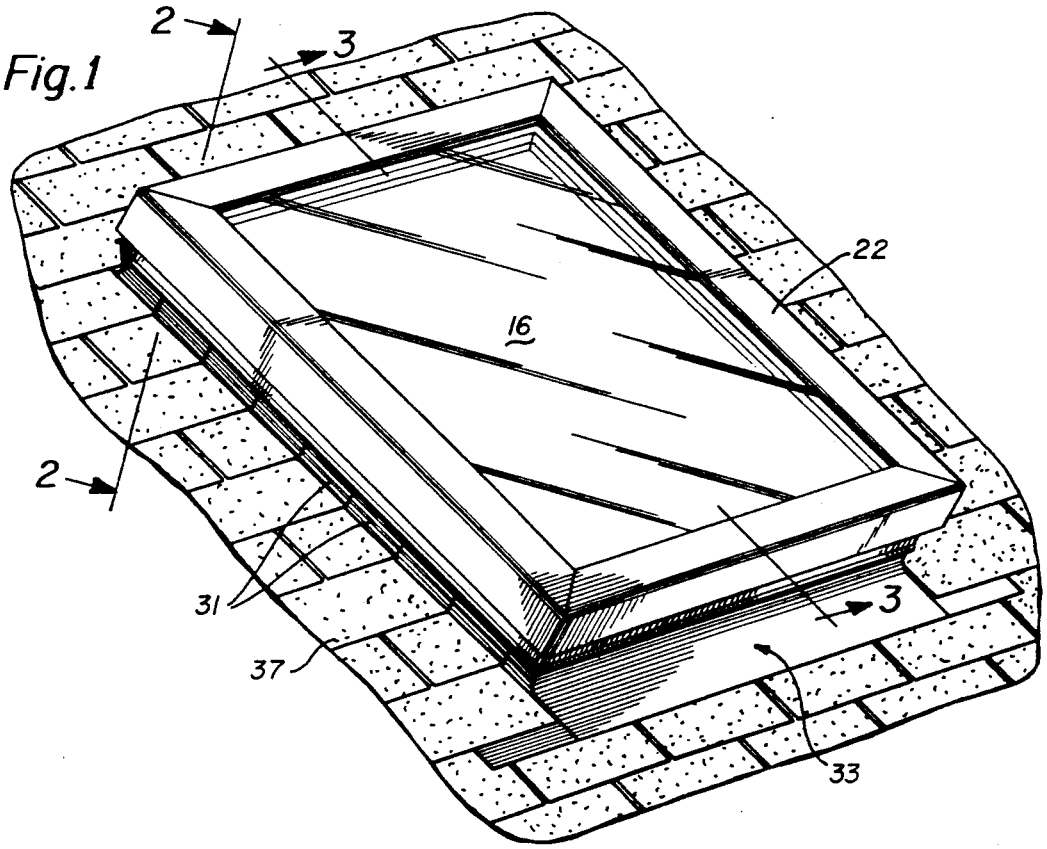
FIG. 1 is a perspective view of the skylight construction of the present invention as secured in a roof.
Figure 2:
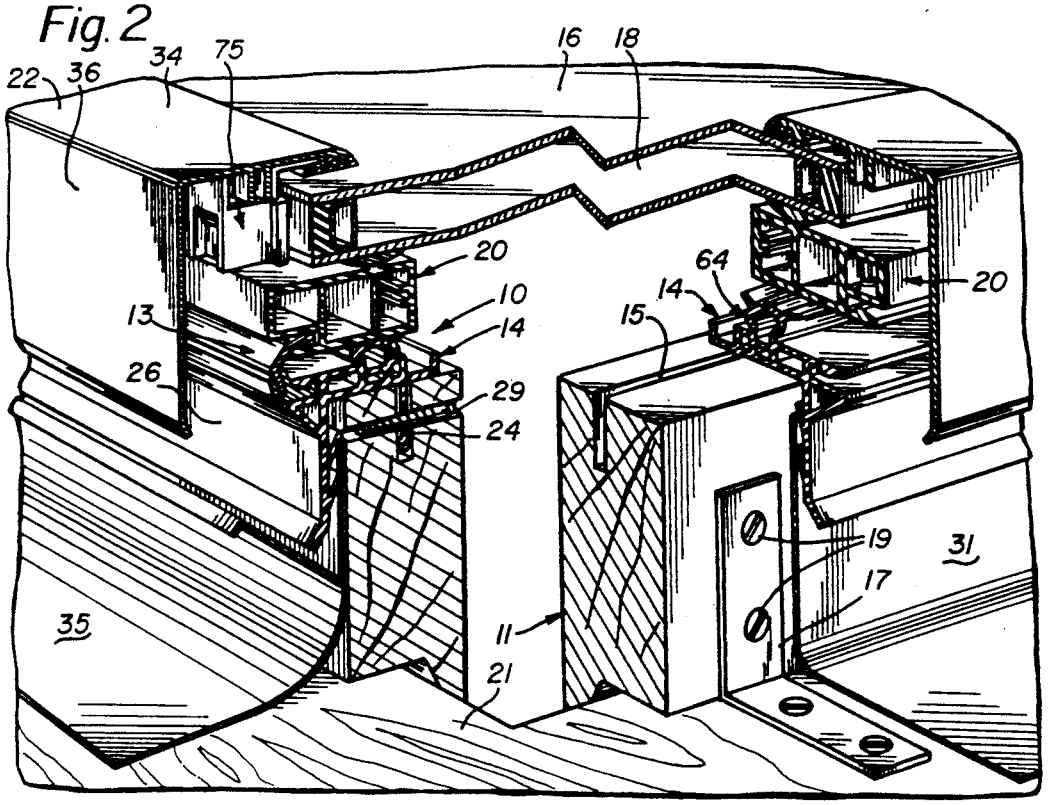
FIG. 2 is a cross-sectional view taken along line 2—2 of FIG. 1 showing further details of the skylight construction illustrated, in particular, an embodiment of the skylight construction in the form of a step flash skylight.
Figure 3:
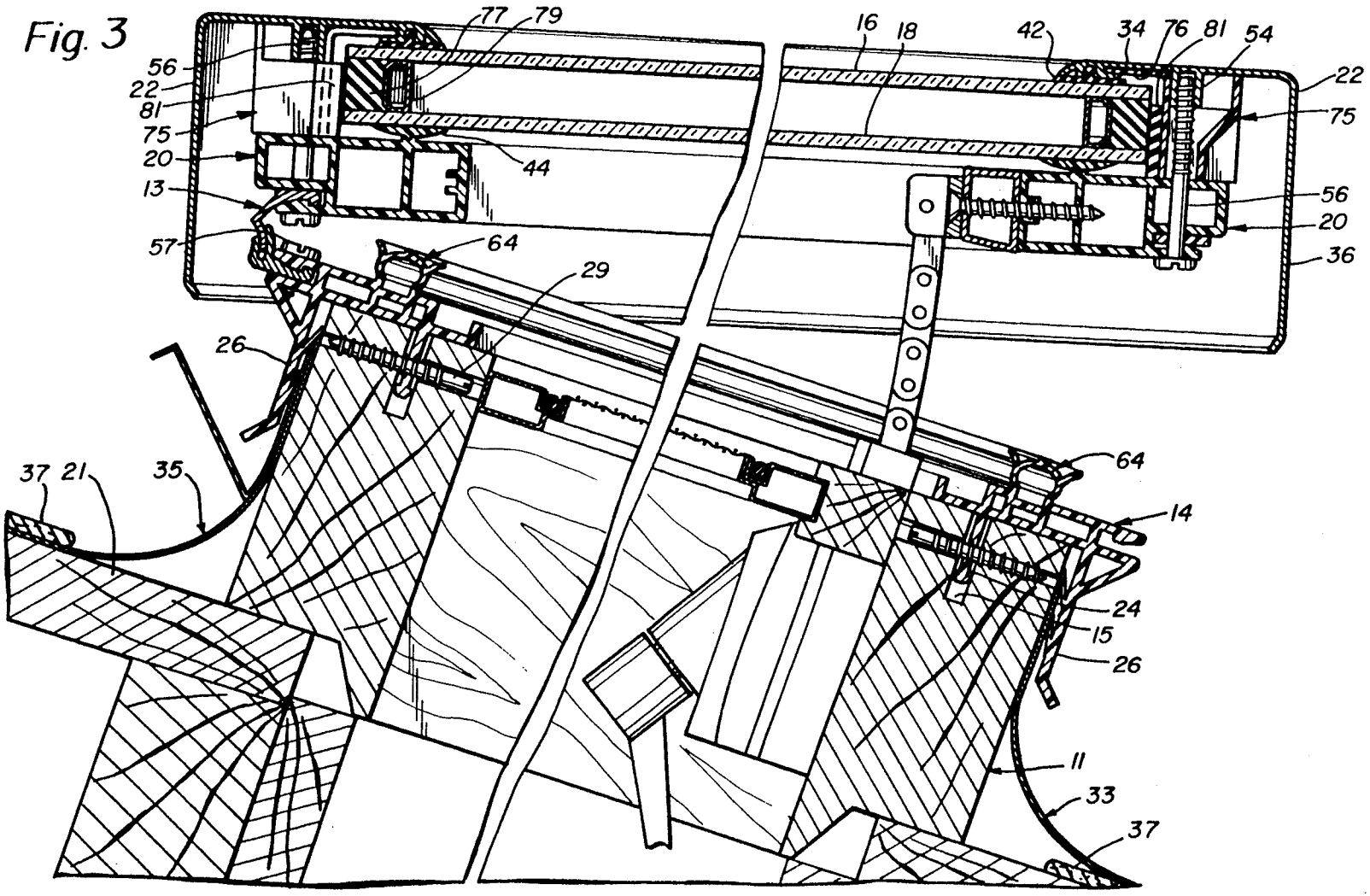
FIG. 3 is a cross-sectional view through the skylight construction of FIGS. 1 and 2 as taken along line 3—3 of FIG. 1.

It is noted that in the embodiment of the invention as illustrated in, for example, FIGS. 1–3, the skylight is of a substantially flat construction employing glazing panels. However, in alternate constructions, a domed type skylight may also be employed. The skylight is adapted to span an opening which is generally of square or rectangular shape and the opening may be defined by upright walls or by headers which are part of the roof construction. Refer in particular to FIG. 3 for an illustration of part of the roof construction.

Disclosed herein in the illustrated embodiments is an operable skylight in which the curb frame is constructed of a base leaf and an operating leaf. However, in alternate embodiments of the invention the curb frame may be of substantially single piece construction and still embody one or more of the concepts of the present invention.

The skylight described herein is characterized by improved energy performance; thermal air and weather tightness; simplicity of installation; good weathering properties; and enhanced durability.

In the embodiments disclosed herein, it is noted that the skylight is illustrated as preferably being of step flash construction. Illustrated herein are various forms of hinge construction. These hinge constructions have a dual purpose use of providing both hinging while also functioning as an impenetratable barrier to water rushing onto the skylight, particularly at the top thereof. These hinge constructions eliminate the necessity for separate water diverter flashing components. The hinge constructions illustrated herein also permit sash removal during installation.

The skylight construction shown herein includes a pair of glazing panels 16 and 18, a rigid plastic curb frame 10 for support of the glazing panels, and a wooden base frame 11. The rigid PVC curb frame 10 in the embodiment illustrated in FIGS. 1–3, is comprised of two separate sections that are hinged as illustrated at 13 in FIG. 3. These two separate sections include a base frame 14 that is adapted to interlock with the wooden base 11, and an overlying sash frame 20. Refer in particular to the exploded cross sectional view of FIG. 4 for an illustration of the specific cross-section configuration of the base frame 14 and the overlying sash frame 20.

The two frames 14 and 20 are constructed of a rigid PVC material and these frames are separately constructed each of separate co extruded pieces formed together in a frame construction.

Figure 4:
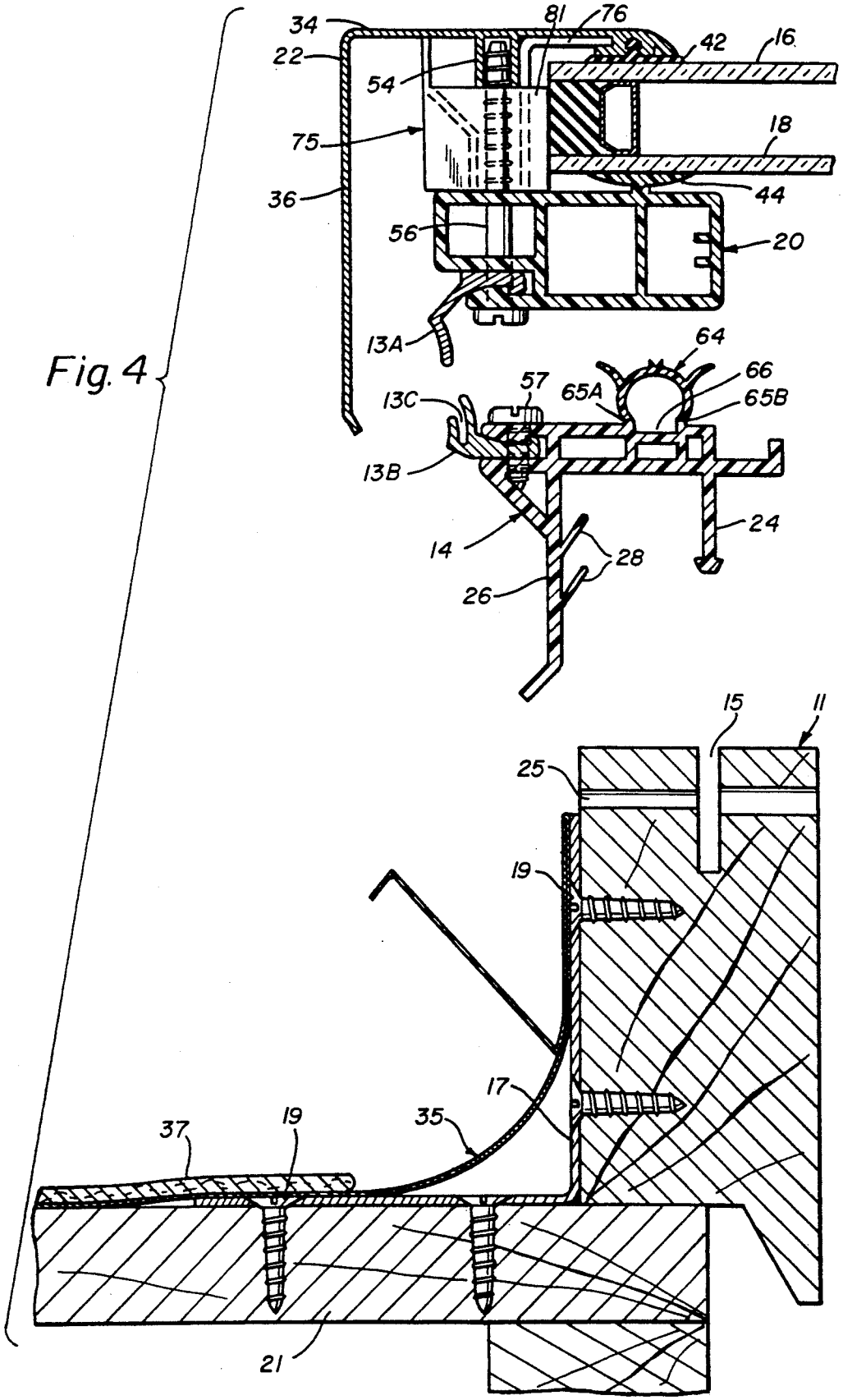
FIG. 4 is an exploded cross sectional view showing further details of components of the skylight construction.

The drawings also illustrate the retainer 22 which is disposed at the very top of the skylight and which is used for securing the glazing panels 16 and 18 to the sash frame 20. The retainer 22 is preferably constructed of a lightweight metal material such as aluminum and has the general L shaped cross-section such as illustrated in FIGS. 3 and 4.

Each of the frames 14 and 20 is constructed by a co-extrusion process in which one or more flexible gaskets are co extruded with the rigid main part of the frame. For example, the frame 20 carries a cupped gasket 44 against which the glazing panel 18 rests. Similarly, the frame 14 carries a flexible sealing gasket 64. The gasket 64 is adapted for gasket support between the frames 14 and 20. In this regard, FIG. 2 illustrates the gasket 64 in its at least partially compressed state sealing between the frames 14 and 20.

The gasket 64 illustrated herein is of similar general construction to the gasket illustrated in our related application Ser. No. 07/283,803 filed Dec. 13, 1988, which application is hereby incorporated by reference herein.

The gasket 64 illustrated in this application does differ somewhat from the gasket illustrated in the aforementioned U.S. Ser. No. 07/283,803 in that it has two separate attachment points at 65A and 65B to the frame 14. The gasket 64 provides multi-point gasketing for locking out air and moisture while providing superior energy efficiency and weather tightness. The gasket 64 is co-extruded with the frame 14 and is thus continuously bonded to the frame for permanent protection.

The gasket 64 with its two point attachment at 65A and 65B, as noted in, for example, FIG. 4, is hollow and generally of tubular construction. It thus provides a space 66 for any weld upset so that it can flow into the space and thus not interfere with the function of the gasket, particularly when it is moved to its compressed stated. In this regard, as noted in FIG. 4, there is actually a recess at 66.

In connection with both the frames 14 and 20, as indicated previously, these are constructed of separate co-extruded pieces that are constructed into a closed frame. At the corner miters, such as illustrated in, for example, FIG. 6, both the rigid and flexible parts of the frames are joined by a technique such as a heat platen sealing technique. This technique commonly joins the rigid frame sections at the corner miters for the same time joining the gaskets for providing a continuous seal above the entire skylight curb frame construction.

Now, with respect to the gasket 64, there is a multipoint contact with the glazing. This is provided by the sealing lip 82 along with the oppositely disposed ears 67A and 67B. This particular construction with the use of a substantially open and tubular gasket configuration provides improved weather and air tightness. Furthermore, there is a reactionary mechanical action that occurs when the gasket is compressed so as to enhance tightness of the gasket between the elements that are being compressed against the gasket.

Reference has been made herein before to the wooden base 11. In this regard, refer also to FIG. 6 which shows the base 11 in place about the opening. It is noted that the base 11 is provided with mortise and tenon corner joints. This provides a rugged interlocking wood joint construction that provides superior strength. Also, this provides a wood curb interior finish that provides for a very asthetic appearance on the inside of the skylight.

To enable the curb frame 10 to be secured to the wooden base 11, the wooden base 11 is provided with a longitudinal slot 15 that is dimensioned to properly receive the downwardly depending leg 24 of the base frame 14.

The wooden base 11 is secured in position about the opening by means of a series of angle brackets 17. The angle brackets 17 are secured by means of screws 19 as illustrated in FIG. 14. This arrangement secures the wooden frame 11 in proper position as illustrated in FIG. 4 and with respect to the roof decking 21.

In accordance with the present invention, the skylight construction also employs a unique step flashing arrangement. The flashing material itself is a superior polyester based dark bronze coating provided on a rule formed aluminum. This is designed for leak proof installation. The arrangement provides for an uncomplicated assembly and disassembly saving time and money. The flashing components are preferably pre fabricated. As illustrated in FIG. 6, the flashing includes side step flashing pieces 31, a sill flashing piece 33 and a head flashing piece 35.

As far as the sequence of installation is concerned, the sill flashing piece 33 is installed first followed by the successive installation of side flashing pieces 31. Shingles 37 are laid over these flashing pieces such as in the illustration of FIG. 4 or FIG. 6. In this connection, FIG. 6 also illustrates the curb frame and, in particular, the base frame 14 positioned over the wooden frame 11.

In the sequence of installation, after the side sill pieces are installed, then the head flashing piece 35 is installed at the top end of the skylight. The next step in the sequence is to install the base frame 14 to the wooden base 11.

The base frame 14 has, in addition to the leg 24, also a counterflashing leg 26 that depends downwardly from the main portion of the frame 14. The leg 26 carries co-extruded and integral weather strips or flashing seals 28. FIG. 4 shows the flashing seals 28 in their normal position. FIG. 5 shows the seals providing their sealing and gasketing function urged against one of the flashing pieces.

FIG. 4 illustrates the base frame 14 in a position yet to be installed in the wooden base 11. FIG. 5 on the other hand shows the frame 14 after installation. For this purpose, the leg 24 is inserted in the slot 15 of the base 11 and a series of securing screws 29 firmly lock the base frame 14 to the wooden base 11. For this purpose, at least the wooden base 11 may be pre drilled with holes such as illustrated at 25 in FIG. 6. The leg 24 may also, at least in one embodiment, be provided with holes that will align with the holes 25. Alternatively, the screw 29 may be adapted to simply drill through the leg 24.

The skylight glazing plates 16 and 18 are supported over the support frame 20 by means of the retainer 22. The plates 16 and 18 are supported by a glazing frame 79. On the outer periphery of the frame 79 between the plates 16 and 18 there is a gasket 77. The gasket 77 may be of a pre molded butyl material. As illustrated in, for example, FIG. 3, the frame 79 may be comprised of a metal spacer with an outer seal comprising a chemically curable two part polysulfied.

The lower glazing plate 18 rests upon the cupped sealing gasket 44 which is co-extruded with the support frame 20. In FIG. 3, the gasket 44 is shown in its compressed position. The sash frame 20 also includes means defining a channel for receiving a securing bolt 56. The bolt 56 at its end, such as illustrated in FIG. 3, is received in an internally threaded flange 54 of the retainer 22. A series of bolts 56 are used spacedly disposed about the frame 20 for securing the glazing in place. A plurality of these securing bolts or screws are employed for securing the retainer 22 over the glazing plates 16 and 18.

As also illustrated in FIGS. 2 and 3 herein, there is provided a glazing cushioning member 75 that forms a cushioning for the edges of the glazing plates to prevent damage thereto, as well as to facilitate positioning thereof. For further details of the glazing cushioning member 75, reference may be made to our co-pending application Ser. No. 07/283,797 which was filed on Dec. 13, 1988, which is hereby incorporated by reference herein.

The retainer 22 has a top leg 34 and a side leg 36. The retainer 22 is generally of L-shaped construction. The top leg 34 of the retainer 22 is adapted to receive a gasket 42 that is relatively flat and that is interlocked with the very free end of the leg 34. The gasket 42 may be constructed of a pre-molded butyl material and is adapted to engage with and securely hold the top of the glazing plates, contacting the plate 16 as illustrated in FIG. 3. The top leg 34 also has a slot defined therein for receiving a leg 76 of the cushioning member 75.

In FIG. 3, the cushioning member 75 is illustrated. It may be constructed either of a lightweight metal material or a hard plastic and supports therefrom a somewhat more resilient and flexible cushioning piece 81. It is the piece 81 that rests directly against the glazing plates as illustrated in FIG. 3. FIG. 3 also illustrates in the completed cross-section part thereof the bolt 56 extending through the frame 20, through the glazing cushioning member 75 and into the threaded flange 54. This arrangement positions the cushioning piece 81 adjacent the edge of the glazing plates as illustrated.

The bolt 56, such as illustrated in FIG. 3, also is used for securing a part of the hinge 13. In this regard, in the particular embodiment of FIG. 3, the hinge 13 is comprised of hinge parts 13A and 13B. The hinge part 13B has a recess 13C for receiving the leg of the hinge part 13A. FIG. 4 illustrates the hinge members separated. FIG. 3 illustrates the hinge members engaged. The hinge member 13B is secured to the lower base frame 14 by means of a further series of securing bolts 57. The hinge parts 13A and 13B may be constructed of a PVC material that is somewhat more flexible than the rigid PVC materials that comprise the frames 14 and 20.

Reference is now made to FIG. 7 for an exploded perspective view of an alternate construction of the present invention. In FIG. 7, it is noted that the same reference characters are used to identify similar parts to those illustrated in FIG. 6. For example, FIG. 7 illustrates the wooden base 11 secured to the decking 21 by means of angle irons 17. The wooden base 11 is provided with the peripheral slot 15. Overlying the wooden base 11 is illustrated the base frame 14. The base frame 14 may be the same as illustrated in FIGS. 1–6.

The particular embodiment illustrated in FIG. 7 is for use in a roofing construction employing roofing tiles 71. The flashing employed includes a sill flashing piece 68, illustrated in FIG. 7 as being secured at the bottom end of the wooden base 11. There is also illustrated in FIG. 7 the side flashing pieces 69, one on either side of the wooden base 11. Finally, there is a head flashing piece 70 that is adapted to mate with the top ends of these side flashing pieces 69.

Reference is now made to FIGS. 8–11 for a preferred embodiment of the hinge construction that interconnects the base frame 14 and the sash frame 20. In FIGS. 8–11, the same reference characters are employed as previously used in connection with the previous embodiment such as the one illustrated in FIGS. 1–5 herein. Accordingly, the skylight construction includes a wooden base 11, a PVC base frame 14, a PVC sash frame 20, a retainer 22, and glazing plates 16 and 18.

Figure 8:
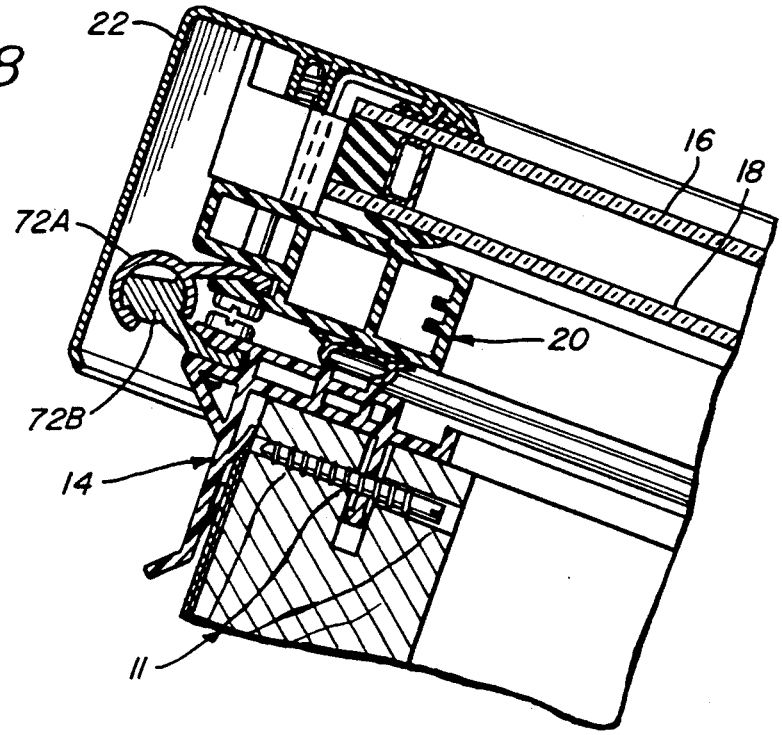
FIG. 8 is a cross-sectional view of an alternate preferred construction for the hinge member of the skylight.
Figure 9:
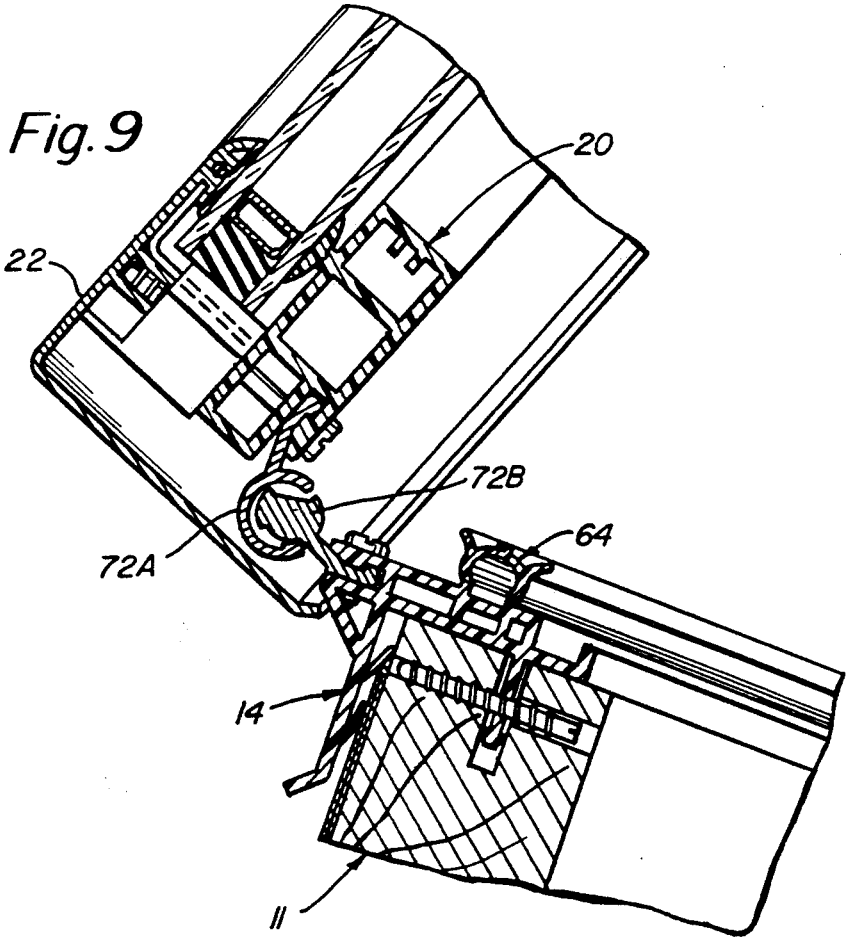
FIG. 9 is a cross-sectional view of the hinge of FIG. 8 showing the skylight in an open position.
Figure 10:
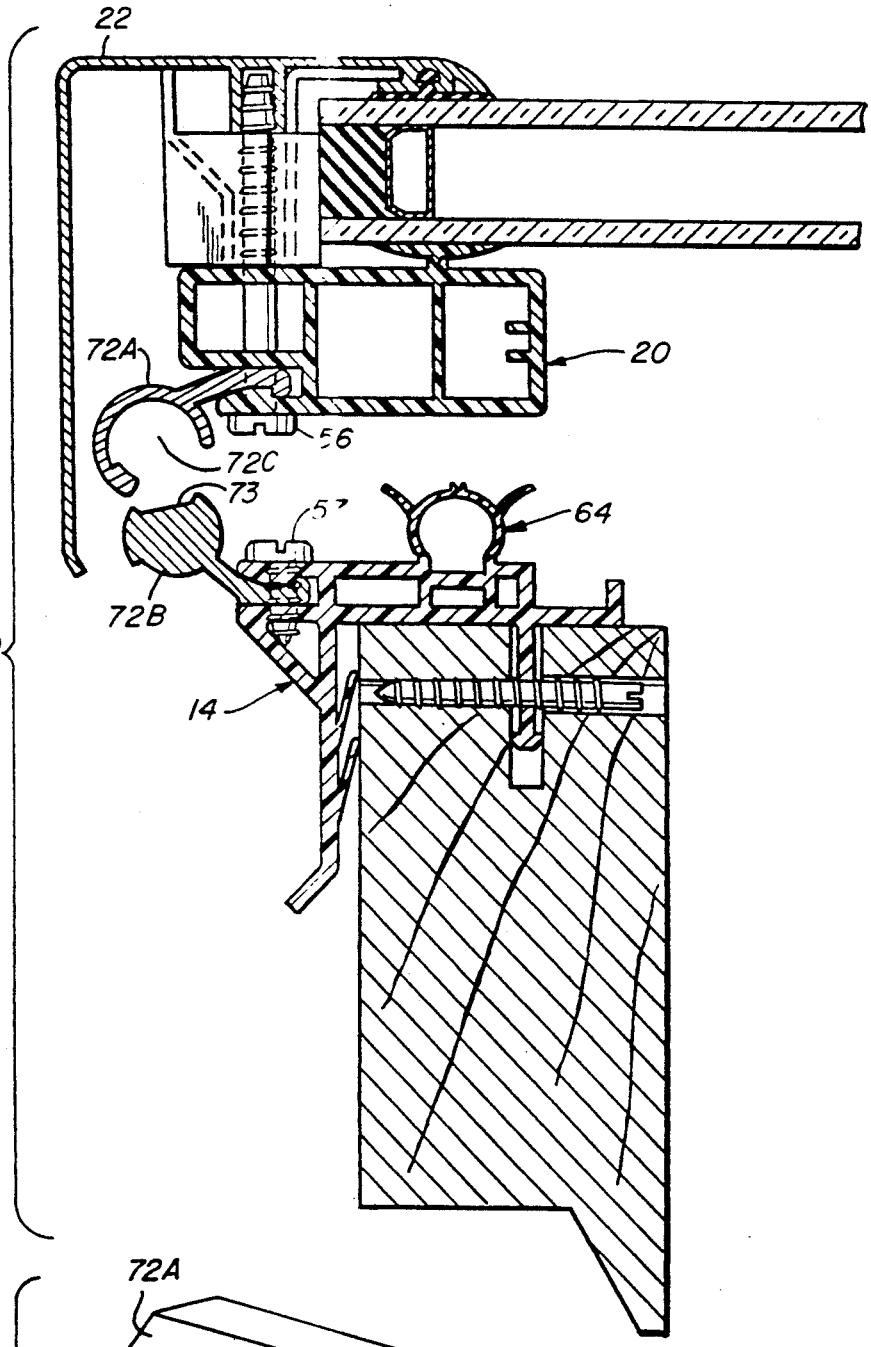
FIG. 10 is an exploded cross-sectional view showing the preferred hinge arrangement of FIGS. 8 and 9.
Figure 11:
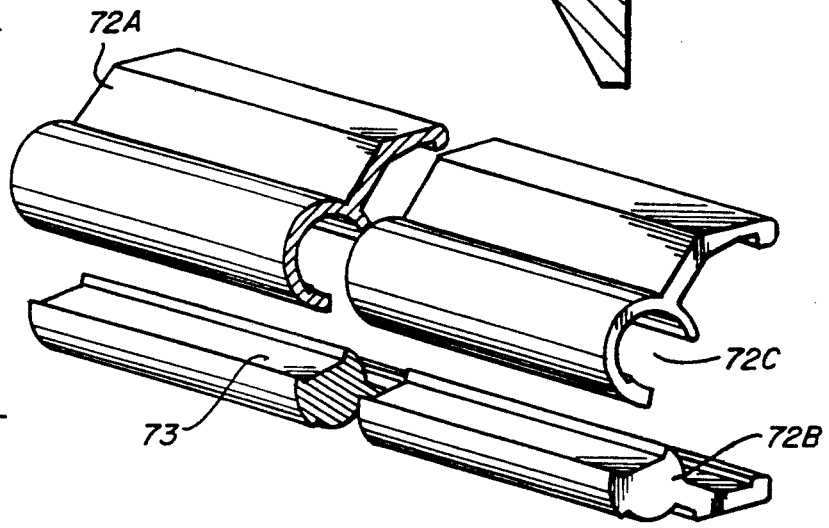
FIG. 11 is an exploded perspective view of the hinge members used in FIGS. 8–10.

The preferred hinge construction includes hinge members 72A and 72B. The member 72A is constructed in a generally C-shape having a recess 72C for receiving the member 72B. The member 72B is of partially circular shape constructed with at least one flat segment 73. When the skylight is closed, these members interlock in a positive fashion as illustrated in FIG. 8 with segments of the hinge members engaging in a positive tight interlocking. When the skylight is opened as in FIG. 9, then the hinge members may be disengaged from each other.

In this way, the sash frame 20 can be removed for installation purposes and can later be re engaged with the base frame of the skylight. It is noted that each of the frame members 72A and 72B have legs for support thereof from the respective frames and for securing by the respective securing bolts 56 and 57.

Having now described a limited number of embodiments of the present invention, it should be apparent to those skilled in the art that numerous other embodiments and modifications thereof are contemplated as falling within the scope of the present invention as defined by the appended claims.

What is claimed is:

1. A skylight construction for an opening in a building or the like comprising: a base member extending about the opening and having means for securing thereof about the opening, a rigid plastic curb frame means, means for firmly securing said rigid plastic curb frame means to the top of said base member, transparent or translucent covering means, means for retaining the covering means on the rigid plastic curb frame means, said means for firmly securing said rigid plastic curb frame means including means for positively interlocking the rigid plastic curb frame means with said base member, said means for positively interlocking defined by said rigid plastic curb frame means having a downwardly depending leg adapted to be accommodated in a slot in said base member, said rigid plastic curb frame means comprising a base frame for engagement with said base member and an overlying sash frame, and further including hinge means between the base frame and the sash frame and including a gasket extending from the base frame and disposed between the base frame and the sash frame.

2. A skylight construction for an opening in a building or the like comprising: a base member extending about the opening and having means for securing thereof about the opening, a rigid plastic curb frame means, means for firmly securing said rigid plastic curb frame means to the top of said base member, transparent or translucent covering means, means for retaining the covering means on the rigid plastic curb frame means, said means for firmly securing said rigid plastic curb frame means including means for positively interlocking the rigid plastic curb frame means with said base member, said means for positively interlocking defined by said rigid plastic curb frame means having a downwardly depending leg adapted to be accommodated in a slot in said base member, said rigid plastic curb frame means comprising a base frame for engagement with said base member and an overlying sash frame, and further including a cupped gasket carried by the sash frame and upon which the covering means rests.

3. A skylight construction for an opening in a building or the like comprising: a base member extending about the opening and having means for securing thereof about the opening, a rigid plastic curb frame means, means for firmly securing said rigid plastic curb frame means to a top surface of said base member, said top surface of said base member being substantially parallel with a lower surface of said curb frame means, transparent or translucent covering means, means for retaining the covering means on the rigid plastic curb frame means, said means for firmly securing said rigid plastic curb frame means including means for positively interlocking the rigid plastic curb frame means with said top surface of said base member, said means for positively interlocking defined by said rigid plastic curb frame means having a downwardly depending leg adapted to be accommodated in a longitudinal slot in said top surface of said base member, said leg substantially orthogonal to said longitudinal slot, and to the top surface of the base member; wherein said means for positively interlocking the rigid plastic curb frame means with the base member includes a bolt or screw.

4. A skylight construction for an opening in a building or the like comprising: a base member extending about the opening and having means for securing thereof about the opening, a rigid plastic curb frame means, means for firmly securing said rigid plastic curb frame means to the top of said base member, transparent or translucent covering means, means for retaining the covering means on the rigid plastic curb frame means, said means for firmly securing said rigid plastic curb frame means including means for positively interlocking the rigid plastic curb frame means with said base member, wherein said means for positively interlocking the rigid plastic curb frame means with the base member includes a securing bolt or screw, and wherein said rigid plastic curb frame means comprises a base frame having a downwardly depending leg adapted to be accommodated in a slot extending longitudinally of said base member.

5. A skylight construction as set forth in claim 4 wherein said base member is constructed of wood and has the slot therein extending peripherally thereabout, said depending leg of said base frame also extending peripherally thereabout.

6. A skylight construction as set forth in claim 5 wherein said securing bolt or screw is adapted to extend through the wooden based member, and through the downwardly depending leg to secure the rigid plastic base frame to the wooden base member.

7. A skylight construction for an opening in a building or the like comprising: a base member extending about the opening and having means for securing thereof about the opening, a rigid plastic curb frame means, means for firmly securing said rigid plastic curb frame means to the top of said base member, transparent or translucent covering means, means for retaining the covering means on the rigid plastic curb frame means, said rigid plastic curb frame means having a peripherally disposed counterflashing piece extending downwardly from the curb frame means and disposed outwardly of said base member, said counterflashing piece having flashing seal means disposed intermediate said counterflashing piece and base member, wherein said flashing seal means comprises at least a pair of spacedly-disposed sealing members, wherein said rigid plastic curb frame means comprises a rigid plastic base frame having a downwardly depending leg adapted to interlock with a slot in the base member, said base member being constructed of wood.

8. A skylight construction as set forth in claim 7 wherein the flashing seal means of the counterflashing piece extends in a direction toward said downwardly depending leg and are positioned therefrom a distance so that the flashing seal means are compressed when the rigid plastic base frame is secured with the wooden base member.

9. A skylight construction for an opening in a building or the like comprising: a base member extending about the opening and having means for securing thereof about the opening, a rigid plastic curb frame means, transparent or translucent covering means, means for retaining the covering means on the rigid plastic curb frame means, said rigid plastic curb frame means comprising a base frame and an overlying sash frame, hinge means for interconnecting said base frame and said sash frame, means for securing said base frame to the top of said base member and including means for positively interlocking said base frame with said base member, said base frame further having a peripherally disposed counterflashing piece extending downwardly therefrom and disposed outwardly of said base member, said counterflashing piece having flashing seal means disposed intermediate said counterflashing piece and base member.

10. A skylight construction as set forth in claim 9 wherein said sealing means are disposed from a portion of the counterflashing piece that extends downwardly.

11. A skylight construction as set forth in claim 9 wherein said sealing means extend at least partially in a direction away from and inward of said counterflashing piece.

12. A skylight construction as set forth in claim 11 wherein said sealing means extend upward of said portion of the counterflashing piece that extends downward.

13. A skylight construction as set forth in claim 9 wherein said means for positively interlocking comprises at least a leg of said plastic base frame that extends downwardly therefrom, said sealing means being disposed in a position between said counterflashing piece and said downwardly depending leg.

14. A skylight construction as set forth in claim 13 wherein said counterflashing piece and said downwardly depending leg are disposed substantially in parallel to each other and furthermore, when said leg is disposed in an accommodating slot of the base member, causes compression and sealing by said sealing means at a position adjacent the side of said base member.

15. A skylight construction as set forth in claim 9, wherein said hinge means comprises separate plastic base frame hinge member and sash frame hinge member.

16. A skylight construction for an opening in a building or the like comprising: a base member extending about the opening and having a means for securing thereof about the opening, a rigid plastic curb frame means, transparent or translucent covering means, means for retaining the covering means on the rigid plastic curb frame means, said rigid plastic curb frame means comprising a base frame and an overlying sash frame, hinge means for interconnecting said base frame and said sash frame, means for securing said base frame to the top of said base member, said base frame further having a peripherally disposed counterflashing piece extending downwardly therefrom and disposed outwardly of said base member, said counterflashing piece having flashing seal means disposed intermediate said counterflashing piece and base member, said sealing means disposed from a portion of the counterflashing piece that extends downwardly.

17. A skylight construction as set forth in claim 16 wherein said sealing means extend at least partially in a direction away from and inward of said counterflashing piece.

18. A skylight construction as set forth in claim 17 wherein said sealing means extend at least partially in a direction upward of said portion of the counterflashing piece that extends downwardly.

* * * * *